United States Patent [19]

Welles

[11] Patent Number: 4,979,240

[45] Date of Patent: Dec. 25, 1990

[54] THERAPEUTIC FOOTREST

[76] Inventor: William F. Welles, 4295 Gesner St., San Diego, Calif. 92117

[21] Appl. No.: 461,850

[22] Filed: Feb. 7, 1990

[51] Int. Cl.[5] ..... E03D 11/00

[52] U.S. Cl. ..... 4/254; 128/25 B

[58] Field of Search ..... 4/254, 574, 611; 297/438, 439; 128/25 B; 272/96, 127

[56] References Cited

U.S. PATENT DOCUMENTS

| | | | |
|---|---|---|---|
| 1,780,479 | 11/1930 | Griffith | 272/96 X |
| 1,938,867 | 12/1933 | Seale | 4/254 |
| 2,023,901 | 12/1935 | Rhodes | 4/254 |
| 2,121,250 | 6/1938 | Koschwitz | 128/25 B |
| 2,250,060 | 7/1941 | Finlay | 4/254 |
| 2,520,307 | 8/1950 | Dorrance | 128/25 B |
| 3,292,614 | 12/1966 | Fleming | 128/25 B |
| 4,347,838 | 9/1982 | McCauley | 272/96 X |
| 4,584,725 | 4/1986 | Oliver | 4/254 |
| 4,713,846 | 12/1987 | Hodroski | 4/254 |

FOREIGN PATENT DOCUMENTS

| | | | |
|---|---|---|---|
| 508641 | 7/1939 | United Kingdom | 4/254 |

*Primary Examiner*—Charles E. Phillips
*Attorney, Agent, or Firm*—Charles C. Logan, II

[57] ABSTRACT

The therapeutic footrest is designed for use while sitting on a toilet seat. The footrest is in the form of a stool having a planar shaped front leg and a planar shaped rear leg that support a horizontally oriented top wall member. A pair of longitudinally spaced apertures are formed in the top surface of the top wall member and a pair of reflex point massage rollers are mounted on shafts in the respective spaced apertures.

7 Claims, 1 Drawing Sheet

THERAPEUTIC FOOTREST

BACKGROUND OF THE INVENTION

The invention relates to a footrest and more particularly to a therapeutic footrest that is used by a person sitting on a toilet.

The user of a conventional toilet is generally seated in a chair-like position, with the femur portion of each leg extending approximately horizontal, and the lower portion of the person's leg downward therefrom. Such conventional toilet position is unnatural, in comparison with the squatting position used by primates in the wild, by person's in primitive societies and in other situaions where seat-type toilets are unavailable. In the natural, squatting position, the femurs are extended or canted upward, with a resulting body which properly aligns the intestines, and allows the right use of gravity and abdominal tension, while relieving strain on sphincter muscles. Precipitation or aggravation of diseases of the urinary, lower digestive and intestional tracks may be attributed to the unnatural position during waste eliminaton caused by use of conventional toilets.

There have been previous attempts to design footstools for use by persons sitting on a toilet. One example is illustrated in the Seale, U.S. Pat. No. 1,938,867. His device has separate footrests that are supported by upright frames that are structurally connected to each other. Another footrest structure is illustrated by the Finlay, U.S. Pat. No. 2,250,060. He again uses separate footrests that are supported by their own legs and which have a connecting member between the rear legs. The Oliver, U.S. Pat. No. 4,584,725 and the Hodroski, U.S. Pat. No. 4,713,846, illustrate separate footrests for each foot that have a box like configuration.

It is an object of the invention to provide a novel therapeutic footrest for use while sitting on a toilet that allows the user to assume a squatting position that allows the thighs to support their abdominal wall.

It is another object of the invention to provide a novel therapeutic footrest for use while sitting on a toilet that promotes natural reflex movement and complete evacuation.

It is another object of the invention to provide a novel therapeutic footrest for use while sitting on a toilet that allows the evacuation reflex to be stimulated by massaging reflex zones on the bottom of the feet.

It is an additional object of the invention to provide a novel therapeutic footrest for use while sitting on a toilet that is economical to manufacture and market.

SUMMARY OF THE INVENTION

The novel therapeutic footrest for use while sitting on a toilet is formed from a planar shaped front leg and a planar shaped rear leg that are attached at their top edge to a horizontally extending top wall member. The length of the top wall member would normally be less than the width of a person's shoulders. A pair of apertures are formed in the top wall member and they are spaced apart a distance approximating that between a person's feet. A spherical roller is mounted on a shaft in each of the apertures. Less than half the height of the roller extends above the top surface of the top wall member.

The therapeutic footrest is preferably made of wood material. It is lightweight and easily stored beside the toilet. When used, it is placed immediately in front of the toilet so that the user may place their feet on the spherical rollers. This produces a squatting position that allows the thighs to support the abdominal wall. In this position the evacuation reflex is stimulated by massaging the reflex zones on the bottom of the feet. This area is in the zone of the bottom of the arch. On the left foot, this area affects the descending colon and on the right foot this area affects the ascending colon.

There are additional positive health advantages gained by use of the novel therapeutic footrest. It aids in complete bowel evacuation. It aids regularity. It produces less stress on the lower back. It prevents abdominal sag and promotes optimum liver function.

An added option of the theraputic footrest is using it to massage tired and sore feet. It produces an invigorating feeling.

DESCRIPTION OF THE DRAWING

FIG. 4 is a partial cross sectional view illustrating the manner in which the rollers are mounted.

DESCRIPTION OF THE PREFERRED EMBODIMENT

Figure 1:
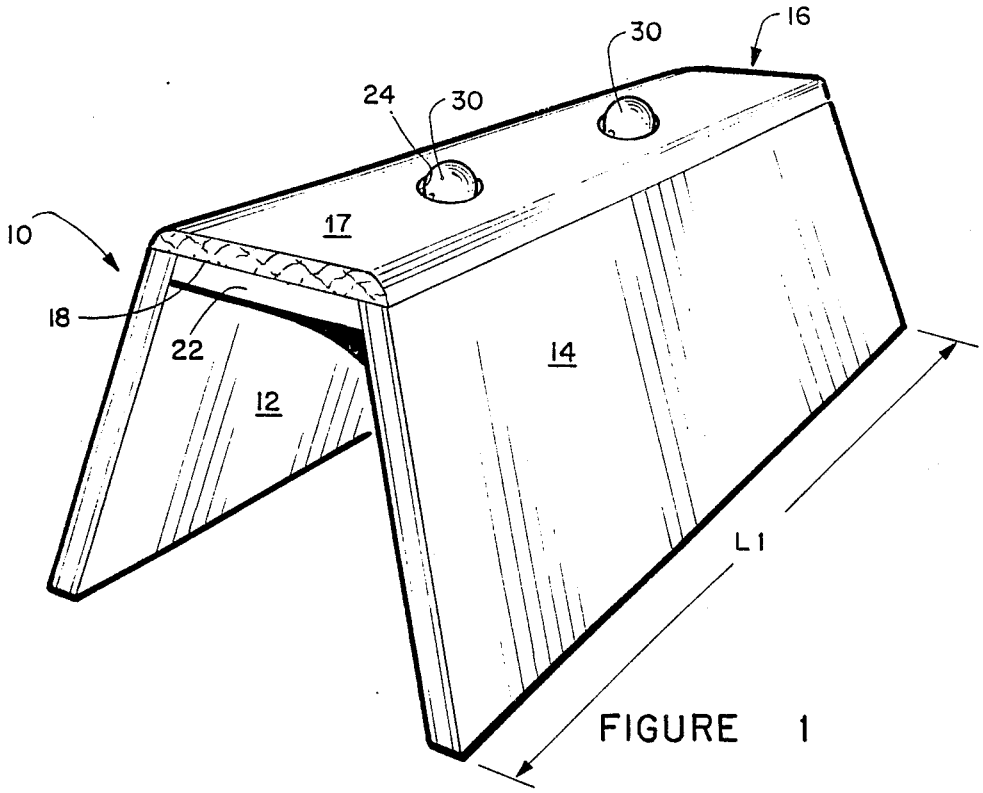
FIG. 1 is a perspective view of applicant's novel therapeutic footrest.
Figure 2:
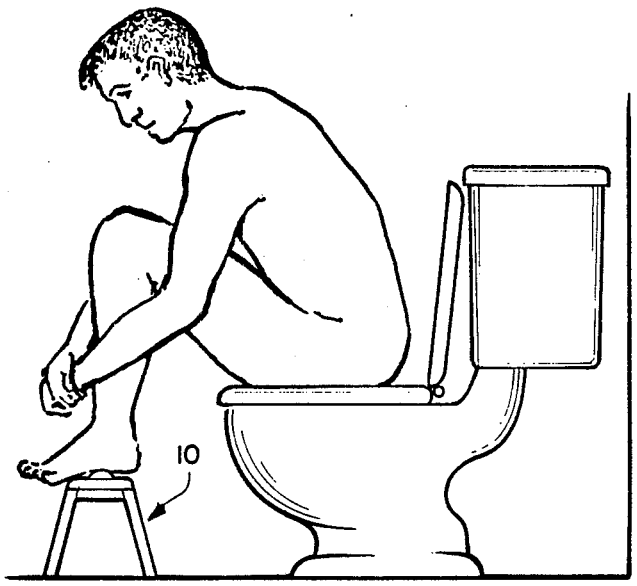
FIG. 2 is a side elevation view illustrating the manner in which the novel theraputic footrest is used.
Figure 3:
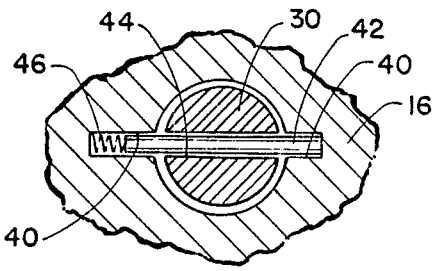
FIG. 3 is a cross sectional view taken along lines 3—3 of FIG. 1.
Figure 3:
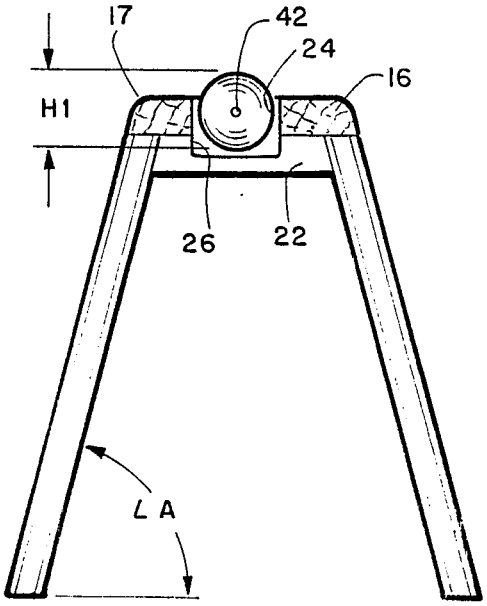

The novel theraputic footrest will now be described by referring to FIGS. 1–4 of the drawing. The footrest is generally designated numeral 10.

Footrest 10 has a front leg 12 and a rear leg 14. A top wall member 16 has a top surface 17 and a bottom surface 18. The top edge of the legs is secured to the bottom surface 18 of top wall member 16. Legs 12 and 14 make an angle A with respect to the horizontal support surface.

A brace member 22 extends the length of top wall member 16 and legs 12 and 14. It's length is L1.

A pair of apertures 24 are formed in the top surface 17 of top wall member 16. They are in alignment with cavities 26 formed in the top surface of brace member 22. The spacing of the apertures is W1. A spherical roller 30 is mounted in each of the cavities. The spherical roller has a height H1.

The manner in which the roller is mounted is illustrated in FIG. 4. A pair of recesses 40 are formed in top wall member 16 on opposite sides of apertures 24. A shaft 42 passes through a bore hole 44 in roller 30. A spring 46 is mounted in one of the recesses 40. Roller 30 is journaled on shaft 42 to freely rotate thereon.

What is claimed is:

1. A therapeutic footrest for use while sitting on a floor mounted toilet comprising:

a horizontally oriented planar top wall member having a longitudinal axis, said top wall member having a top surface and a bottom surface;

a plurality of legs each having a top edge and a bottom edge, the top edge of said legs being secured to the bottom surface of said top wall member and supporting said top surface above said floor such a distance that a normal adult user with is feet positioned on said top surface will be oriented in a squat position on said toilet;

a pair of spherical rollers having a predetermined height a pair of apertures spaced along said axis in the top surface of said top wall member;

a pair of horizontally oriented shafts, one of said shafts passing through each of said respective spherical rollers; and said shafts mounting said rollers in said respective apertures in said top wall member so that a portion of said rollers protrudes above said top surface and may be rotated as the user moves the bottom of his feet there across while sitting on a toilet, thus allowing the evacuation reflex to be stimulated by massaging reflex zones on the bottom of the users feet.

2. A therapeutic footrest as recited in claim 1 further comprising a horizontally oriented brace member having a length substantially the same as said top wall member, said brace member having a top surface that is attached to the bottom surface of said top wall member.

3. A therapeutic footrest as recited in claim 2 wherein the top surface of said brace member has a pair of spaced cavities that align with the respective apertures in said top wall member so that said rollers can be received therein and less than fifty percent of the height of said spherical rollers will extend above the top surface of said top wall member.

4. A therapeutic footrest as recited in claim 1 wherein said top wall member and said legs are made of wood material.

5. A therapeutic footrest as recited in claim 1 wherein there are only two legs, a front leg and a rear leg.

6. A therapeutic footrest as recited in claim 5 wherein said legs have the shape of planar wall members.

7. A therapeutic footrest as recited in claim 6 wherein said legs extend upwardly at an angle of less than ninety degrees.

* * * * *